US012031267B2

(12) United States Patent
Ito

(10) Patent No.: US 12,031,267 B2
(45) Date of Patent: Jul. 9, 2024

(54) SYNTHETIC LEATHER

(71) Applicant: SEIREN CO., LTD., Fukui (JP)

(72) Inventor: Haruki Ito, Fukui (JP)

(73) Assignee: SEIREN CO., LTD., Fukui (JP)

( * ) Notice: Subject to any disclaimer, the term of this patent is extended or adjusted under 35 U.S.C. 154(b) by 161 days.

(21) Appl. No.: 17/607,228

(22) PCT Filed: May 12, 2020

(86) PCT No.: PCT/JP2020/019000
§ 371 (c)(1),
(2) Date: Oct. 28, 2021

(87) PCT Pub. No.: WO2020/261785
PCT Pub. Date: Dec. 30, 2020

(65) Prior Publication Data

US 2022/0220667 A1 Jul. 14, 2022

(30) Foreign Application Priority Data

Jun. 24, 2019 (JP) ..... 2019-116644

(51) Int. Cl.
*D06N 3/00* (2006.01)
*D06N 3/14* (2006.01)

(52) U.S. Cl.
CPC ..... *D06N 3/0043* (2013.01); *D06N 3/0061* (2013.01); *D06N 3/0097* (2013.01); *D06N 3/145* (2013.01); *D06N 3/146* (2013.01); *D06N 3/147* (2013.01); *D06N 3/0009* (2013.01); *D06N 3/0036* (2013.01); *D06N 2211/28* (2013.01); *D06N 2213/03* (2013.01)

(58) Field of Classification Search
CPC .... D06N 3/0043; C08G 71/04; C04B 16/082; C08L 75/04; C09D 175/04; C08F 290/067; C08F 290/147
See application file for complete search history.

(56) References Cited

U.S. PATENT DOCUMENTS 3,582,396 A * 6/1971 Konig ..... B32B 27/00 521/64
3,873,406 A * 3/1975 Okazaki ..... D06N 3/0063 428/142

(Continued)

FOREIGN PATENT DOCUMENTS

CN 105408543 A 3/2016
JP 49-47503 A 5/1974

(Continued)

OTHER PUBLICATIONS

"JP2014012914_Machine Translation" is a machine translation of JP-2014012914-A. (Year: 2014).*

(Continued)

*Primary Examiner* — Larissa Rowe Emrich
(74) *Attorney, Agent, or Firm* — WHDA, LLP

(57) ABSTRACT

Provided is a synthetic leather including a fibrous substrate, a porous resin layer provided on the fibrous substrate, and a non-porous resin layer provided on the porous resin layer.

(Continued)

The synthetic leather has a thickness of 800 μm or more, and a vertical cross-section of the porous resin layer has a pore area ratio of 25% or more.

17 Claims, 2 Drawing Sheets

(56) References Cited

U.S. PATENT DOCUMENTS

| | | | | | |
|---|---|---|---|---|---|
| 4,018,954 | A * | 4/1977 | Fukushima | ..... | D06N 3/004 428/95 |
| 2010/0093243 | A1 * | 4/2010 | Uemura | ..... | B32B 5/026 442/304 |
| 2012/0208418 | A1 | 8/2012 | Yea et al. | | |
| 2021/0222361 | A1 * | 7/2021 | Heo | ..... | D06N 3/14 |

FOREIGN PATENT DOCUMENTS

| | | | | | |
|---|---|---|---|---|---|
| JP | 52-64403 | A | | 5/1977 | |
| JP | S5264403 | A | * | 5/1977 | ..... D06N 3/00 |
| JP | 59-88980 | A | | 5/1984 | |
| JP | H09239886 | A | * | 9/1997 | ..... B29C 47/02 |
| JP | 2012-197547 | A | | 10/2012 | |
| JP | 2013-510964 | A | | 3/2013 | |
| JP | 2013-208814 | A | | 10/2013 | |
| JP | 2014-12914 | A | | 1/2014 | |
| JP | 2014012914 | A | * | 1/2014 | |
| JP | 6353833 | B2 | * | 7/2018 | ..... B32B 27/08 |
| KR | 20170123431 | A | * | 11/2017 | ..... D06N 3/00 |
| WO | 2010/137264 | A1 | | 12/2010 | |

OTHER PUBLICATIONS

"JPH09239886_Machine Translation" is a machine translation of JP-H09239886-A. (Year: 1997).*

"JPS5264403_Machine Translation" is a machine translation of JP-S5264403-A. (Year: 1977).*

"JP6353833_Machine Translation" is a machine translation of JP-6353833-B2. (Year: 2018).*

"KR20170123431_Machine Translation" is a machine translation of KR-20170123431-A. (Year: 2017).*

"JPS5264403_Partial Translation" is a partial translation of JP-S5264403-A. (Year: 1977).*

International Search Report dated Jul. 28, 2020, issued in counterpart International Application No. PCT/JP2020/019000. (3 pages).

Extended (Supplementary) Search Report dated Jun. 21, 2023, issued in counterpart EP Application No. 20831555.6. (6 pages).

Office Action dated Jun. 22, issued in counterpart CN Application No. 202080045806.6, with English translation. (36 pages).

Office Action dated Feb. 11, 2023, issued in counterpart CN application No. 202080045806.6, with English translation. (33 pages).

Office Action dated Mar. 28, 2023, issued in counterpart JP application No. 2019-116644, with English translation. (6 pages).

Office Action dated Nov. 30, 2023, issued in counterpart CN application No. 202080045806.6, with English machine translation. (24 pages).

* cited by examiner

FIG. 3 ( A )
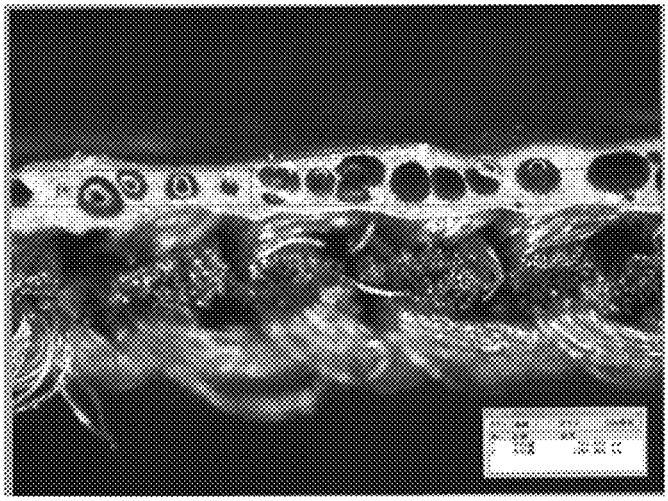
FIG. 3 ( B )
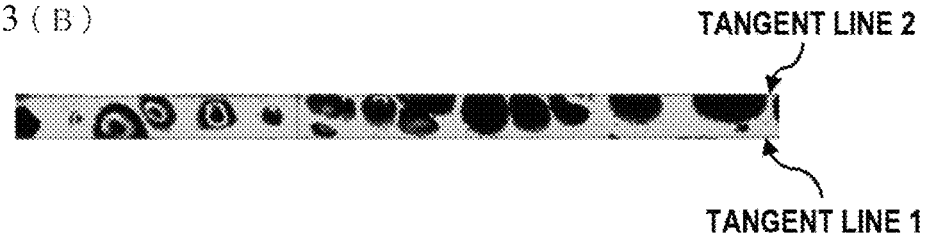

SYNTHETIC LEATHER

TECHNICAL FIELD

The present invention relates to a synthetic leather and a method for producing the same.

BACKGROUND ART

Conventionally, as a skin material for car interior materials and interior decoration materials, a synthetic leather in which a resin layer composed of a polyurethane resin or polyvinyl chloride resin is provided on a fibrous substrate has been used. Such skin materials are cut into desired shapes and sewn before use. However, because the surface of a synthetic leather is formed of a hard resin layer, there is a problem in that upon sewing, wrinkles are likely to occur at the stitched part.

In order to solve the above problem, PTL 1 discloses an artificial synthetic leather improved in terms of sewing wrinkles that occur at the stitched part after sewing, obtained by combining a skin made of PVC or polyurethane with a knit fabric having a core yarn inserted into the fabric structure, a knit fabric having an elastic yarn interwoven together, or a knit fabric having a core yarn inserted into the fabric and an elastic yarn interwoven together.

CITATION LIST

Patent Literature

PTL 1: JP-T-2013-510964 (the term "JP-T" as used herein means a published Japanese translation of a PCT patent application)

SUMMARY OF INVENTION

Technical Problem

However, in the artificial synthetic leather of PTL 1, although sewing wrinkles are improved, there has been a problem in that its texture is hard.

Embodiments of the invention have been accomplished in view of such situations, and an object thereof is to provide a synthetic leather in which the occurrence of sewing wrinkles upon sewing is suppressed and which has an excellent texture.

Solution to Problem

A synthetic leather according to an embodiment of the invention includes a fibrous substrate, a non-porous resin layer, and a porous resin layer provided between the fibrous substrate and the non-porous resin layer. The synthetic leather has a thickness of 800 μm or more. A vertical cross-section of the porous resin layer has a pore area ratio of 25% or more.

A method for producing a synthetic leather according to an embodiment of the invention is a method for producing the synthetic leather described above and includes the following steps in the following order: a step of applying a resin liquid for a non-porous resin layer onto a releasable substrate to form a non-porous resin layer, a step of applying a resin liquid for a porous resin layer onto the non-porous resin layer to form a porous resin layer, a step of attaching the porous resin layer and a fibrous substrate together, and a step of peeling the releasable substrate.

Advantageous Effects of Invention

According to embodiments of the invention, it is possible to provide a synthetic leather in which the occurrence of sewing wrinkles upon sewing is suppressed and which has an excellent texture.

BRIEF DESCRIPTION OF DRAWINGS

FIG. 3(A) is a cross-sectional image of a synthetic leather of an example, and FIG. 3(B) is an image of its porous resin layer trimmed therefrom.

DESCRIPTION OF EMBODIMENTS

Figure 1:
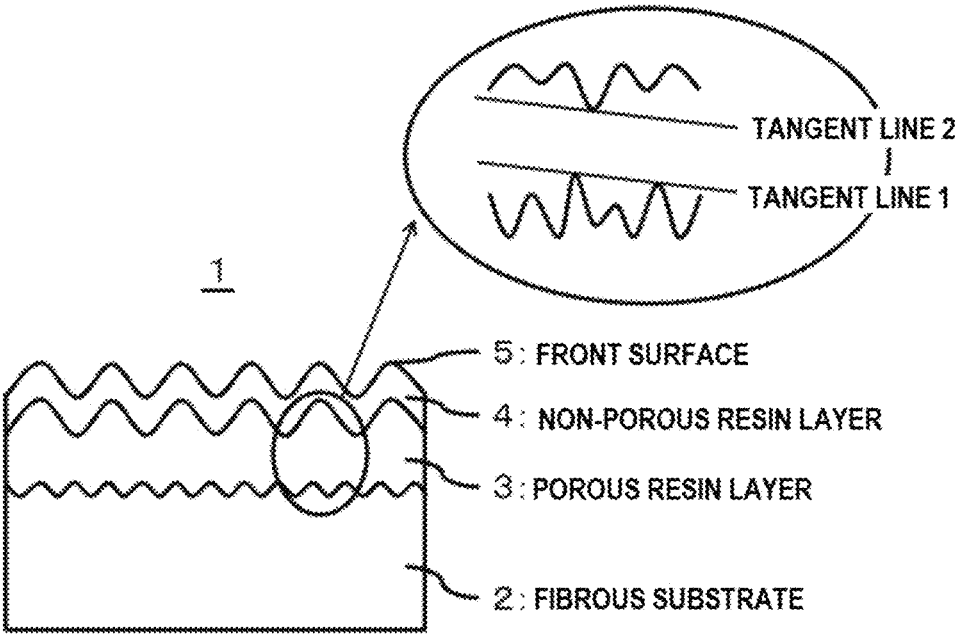
FIG. 1 is a cross-sectional schematic diagram of a synthetic leather according to one embodiment.

A synthetic leather according to this embodiment is a synthetic leather including, on a fibrous substrate, a porous resin layer and a non-porous resin layer laminated in this order. That is, the synthetic leather includes a fibrous substrate, a porous resin layer provided on the fibrous substrate, and a non-porous resin layer provided on the porous resin layer. The synthetic leather has a thickness of 800 μm or more, and a vertical cross-section of the porous resin layer has a pore area ratio of 25% or more.

When the thickness of the synthetic leather is 800 μm or more, presumably, the distortion that occurs in the synthetic leather upon sewing is easily absorbed. As a result, a synthetic leather in which the occurrence of sewing wrinkles upon sewing is suppressed can be achieved. The thickness of the synthetic leather is preferably 900 μm or more. The upper limit of the thickness of the synthetic leather is not particularly set, and may be, for example, 10,400 μm or less, or may also be 2,250 μm or less.

In addition, when the pore area ratio of the porous resin layer is 25% or more, the porous resin layer has a high void ratio, and therefore, presumably, the distortion that occurs in the synthetic leather upon sewing is easily absorbed by voids. As a result, a synthetic leather in which the occurrence of sewing wrinkles upon sewing is suppressed and which has an excellent texture can be achieved. Here, the pore area ratio of a porous resin layer is the proportion of pores in a vertical cross-section of the porous resin layer.

Because of the above configuration, when the synthetic leather of this embodiment is used as a skin material and, for example, subjected to ease sewing, the distortion that occurs upon ease can be reduced. That is, because the synthetic leather has a sufficient thickness, and also its porous resin layer has a high void ratio, the force of distortion that has occurred as a result of ease is easily dispersed, and the force for generating sewing wrinkles (tension) can be reduced. Accordingly, a synthetic leather in which the occurrence of sewing wrinkles upon sewing, especially at the time of ease sewing, is suppressed can be achieved. Here, ease sewing (ease) is a sewing method in which for the purpose of making a flat cloth (here, synthetic leather) three-dimensional, the cloth is contracted and sewed finely in a manner invisible on the surface.

From the standpoint of texture, it is preferable that the synthetic leather according to this embodiment has a BLC value of 4.5 mm or more. The upper limit of the BLC value is not particularly set, but is, from the standpoint of sewing wrinkles, preferably 6.5 mm or less, and more preferably 6.0 mm or less. The BLC value serves as an index of the feel texture characteristics of leather, and the larger this value is, the softer the texture of the synthetic leather is.

Here, the BLC value can be determined as follows. That is, one 150-mm square test piece is taken from a synthetic leather and, using ST300 Leather Softness Tester (manufactured by BLC Leather Technology Center Ltd.), pushed in with a load of 500 g, and the resulting distortion measurement value (BLC value) is measured. A larger distortion measurement value indicates higher flexibility and a better texture.

FIG. 1 schematically shows the cross-sectional structure of a synthetic leather 1 according to one embodiment. In the synthetic leather 1, a porous resin layer 3 and a non-porous resin layer 4 are laminated in this order on one side of a fibrous substrate 2. In addition, a front surface 5 of the synthetic leather 1 has depressions and projections. The surface of the non-porous resin layer 4 is the front surface 5 of the synthetic leather 1, and the depressions and projections are provided on this front surface 5. Further, the back surface of the porous resin layer 3 and its front surface (i.e., the back surface of the non-porous resin layer 4) each also have depressions and projections. Here, the front surface of a synthetic leather means, of the front and back of the synthetic leather, the surface that is visible when used (design surface), The front surface of a porous resin layer means, of the front and back of the porous resin layer, the surface on the non-porous resin layer side. In the example of FIG. 1, the front surface of the porous resin layer 3 is the interface between the porous resin layer 3 and the non-porous resin layer 4, and this interface has depressions and projections.

Figure 2:
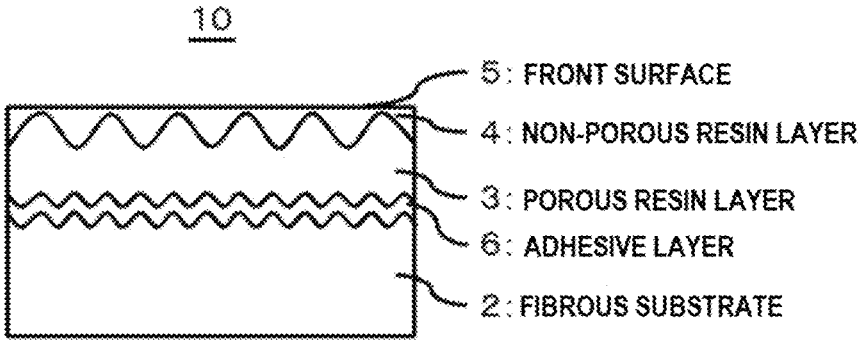
FIG. 2 is a cross-sectional schematic diagram of a synthetic leather according to another embodiment.

FIG. 2 schematically shows the cross-sectional structure of a synthetic leather 10 according to another embodiment. In the synthetic leather 10, an adhesive layer 6 is provided between the fibrous substrate 2 and the porous resin layer 3. That is, in the example of FIG. 2, the adhesive layer 6, the porous resin layer 3, and the non-porous resin layer 4 are laminated in this order on one side of the fibrous substrate 2. Like this, in the invention, the porous resin layer may be provided directly on the fibrous substrate, or may also be provided via another layer, such as an adhesive layer, on the fibrous substrate. Further, the non-porous resin layer may be provided directly on the porous resin layer, or may also be provided via another layer, such as an adhesive layer, on the porous resin layer.

In the example shown in FIG. 2, the front surface 5 of the synthetic leather 10 has no depressions or projections. That is, the front surface 5 of the synthetic leather 10 is flat. Like this, the front surface of the synthetic leather may be flat or may also have depressions and projections as in the example shown in FIG. 1. Similarly, the front surface and back surface of the porous resin layer may each also be flat or have depressions and projections. In the example of FIG. 2, the interface between the porous resin layer 3 and the non-porous resin layer 4, which is the front surface of the porous resin layer 3, has depressions and projections. Incidentally, the depressions and projections on the back surface of the porous resin layer may be depressions and projections derived from the fibrous substrate. Further, the depressions and projections on the front surface of the synthetic leather and the depressions and projections on the front surface of the porous resin layer may be a pattern of depressions and projections formed by a releasable substrate.

In this embodiment, the fibrous substrate is not particularly limited, and examples thereof include fabrics, such as knitted fabrics, woven fabrics, and non-woven fabrics, and natural leathers (including split leather). Among them, knitted fabrics and woven fabrics are preferable, and knitted fabrics are more preferable. It is also possible to use a fabric coated or impregnated with a conventionally known solvent-based or solvent-free-based (including water-based) polymer compound (e.g., polyurethane resin or polyvinyl chloride resin) and dry-coagulated or wet-coagulated. Incidentally, the fibrous substrate may also be colored with a dye or a pigment.

The kind of fiber constituting the fibrous substrate is not particularly limited either. Conventionally known fibers such as natural fibers, regenerated fibers, semi-synthetic fibers, and synthetic fibers can be mentioned, and it is also possible to use a combination of two or more kinds thereof. Among them, from the standpoint of strength and processability, synthetic fibers are preferable, polyester fibers are more preferable, and polyethylene terephthalate fibers are particularly preferable.

The thickness (T1) of the fibrous substrate is not particularly limited, and is preferably 400 to 10,000 μm, more preferably 500 to 2,000 μm. When the thickness of the fibrous substrate is 400 μm or more, the force for generating sewing wrinkles (tension) can be reduced, which is advantageous in suppressing sewing wrinkles and obtaining an excellent texture. When the thickness of the fibrous substrate is 10,000 μm or less, the wear resistance can be improved.

The density (S1) (apparent density) of the fibrous substrate is not particularly limited, and is preferably 0.05 to 1.0 $g/cm^3$, more preferably 0.05 to 0.5 $g/cm^3$. When the density of the fibrous substrate is 0.05 $g/cm^3$ or more, the wear resistance can be improved. When the density of the fibrous substrate 1.0 $g/cm^3$ or less, this is advantageous in suppressing sewing wrinkles and obtaining an excellent texture. Here, the density of a fibrous substrate is calculated from its basis weight ($g/cm^2$) and thickness (cm).

In the synthetic leather according to this embodiment, a porous resin layer is laminated as a first resin layer on the fibrous substrate described above.

A porous resin layer is a resin layer having a large number of pores. The form of pores is not particularly limited, and both closed pores and open pores are possible. In particular, from the standpoint of wear resistance, closed pores (i.e., non-penetrating, closed pores) are preferable.

The shape of pores is not particularly limited, and may be regular or irregular, and spherical or elongated spherical.

The size of pores is not particularly limited, and the pore major axis is preferably 10 to 200 μm, and more preferably 15 to 100 μm. When the pore major axis is 10 μm or more, voids in the porous resin layer increase in size, and it is possible to make it easy to absorb the distortion that occurs upon sewing. This is advantageous in suppressing sewing wrinkles and obtaining an excellent texture. When the pore major axis is 200 μm or less, the wear resistance can be improved.

Here, the pore major axis is the major axis of a pore that appears in a vertical cross-section of the porous resin layer. When the pore is spherical (circular in the cross section), the term means its diameter, while when not spherical, the term means the length of the greatest dimension, Specifically, in a microscopic observation image of a vertical cross-section of the porous resin layer, the major axis of the pore having the largest major axis among a plurality of pores appearing in the vertical cross-section is measured. This measurement is performed on vertical cross-sections at ten horizontally consecutive points of the porous resin layer. The maximum and minimum values are excluded, and the average at the remaining eight points is defined as the pore major axis.

The density (S2) (apparent density) of the porous resin layer is not particularly limited, and is preferably 0.1 to 2.0 g/cm$^3$, more preferably 0.5 to 1.0 g/cm$^3$. When the density of the porous resin layer is 0.1 g/cm$^3$ or more, the wear resistance can be improved. When the density of the porous resin layer is 2.0 g/cm$^3$ or less, this is advantageous in suppressing sewing wrinkles and obtaining an excellent texture. Here, the density of a porous resin layer is calculated from its basis weight (g/cm$^2$) and thickness (cm).

The average density (S12) of a combined layer of the fibrous substrate and the porous resin layer is not particularly limited, and is preferably 0.1 to 1.0 g/cm$^3$, more preferably 0.2 to 0.5 g/cm$^3$. When the average density of the combined layer of the fibrous substrate and the porous resin layer is 0.1 g/cm$^3$ or more, the wear resistance can be improved. When the average density of the combined layer of the fibrous substrate and the porous resin layer is 1.0 g/cm$^3$ or less, this is advantageous in suppressing sewing wrinkles and obtaining an excellent texture.

Here, the average density (S12) of a combined layer of the fibrous substrate and the porous resin layer can be calculated from the following formula.

$$S12\ [g/cm^3]=\{(\text{density of fibrous substrate}[g/cm^3]\times\text{thickness of fibrous substrate [cm]})+(\text{density of porous resin layer }[g/cm^3]\times\text{thickness of porous resin layer [cm]})\}\div(\text{thickness of fibrous substrate [cm]}+\text{thickness of porous resin layer [cm]})$$

The thickness (T2) of the porous resin layer is not particularly limited, and is preferably 20 to 300 μm, more preferably 50 to 200 μm, and still more preferably 100 to 200 μm. When the thickness of the porous resin layer is 20 μm or more, this is advantageous in suppressing sewing wrinkles and obtaining an excellent texture. When the thickness of the porous resin layer is 300 μm or less, the wear resistance can be improved.

In this embodiment, the pore area ratio of the porous resin layer, that is, the proportion of pores in a vertical cross-section of the porous resin layer, is 25% or more as described above. The pore area ratio of the porous resin layer is preferably 35% or more. The upper limit of the pore area ratio of the porous resin layer is not particularly set, but is preferably 70% or less, and more preferably 55% or less. When the pore area ratio of the porous resin layer is 70% or less, the wear resistance can be improved.

The method for calculating the pore area ratio of a porous resin layer is as follows. Through the microscopic observation and image processing of a vertical cross-section of the layer, the area ratio of the pore part relative to the area occupied by the whole porous resin layer in the vertical cross-section is determined.

That is, the porous resin layer in a vertical cross-section of a test piece is observed under a microscope (manufactured by KEYENCE CORPORATION, VHX-200/100F) at a magnification of 100.

Of a plurality of projecting portions on the back surface (fibrous substrate side) of the porous resin layer, the two highest ones are selected, and a tangent line 1 connecting the peaks of the two projecting portions is drawn (see FIG. 1). Next, of a plurality of depressed portions on the front surface (non-porous resin layer side) of the porous resin layer, the one deepest depressed portion is selected, and, taking the bottom point of the depressed portion as a tangent point, a tangent line 2 is drawn parallel to the tangent line 1. With respect to the image having the tangent line 1 and tangent line 2 drawn, using "Office Picture Manager" of Microsoft Corporation, the angle of the image is finely tuned by 0.1° increments to correct the image so that the tangent line 1 and tangent line 2 are horizontal (see FIG. 3(A)). Subsequently, the portion surrounded by the tangent line 1, the tangent line 2, and the left and right ends of the porous resin layer is trimmed, and the trimmed portion (see FIG. 3(B)) is defined as the area occupied by the whole porous resin layer. The trimmed portion is binarized using the image software of IMAGE J to determine the area ratio of the pore part (=(pore area/total area)×100). The above operation is performed at ten horizontally consecutive points of the porous resin layer. The maximum and minimum values are excluded, and the average of the area ratios of the remaining eight points is defined as the pore area ratio.

Incidentally, in the case where depressions and projections are not formed on the front surface of the porous resin layer, a tangent line 2 parallel to the tangent line 1 is drawn in a manner to maximize the distance between the tangent line 1 and the tangent line 2 without including the non-porous resin layer, and, as in the above case of having depressions and projections, the image is binarized into the pore part and the non-pore part, and the area ratio of the pore part is determined.

In addition, in the case where depressions and projections are not formed on the front surface and back surface of the porous resin layer, the porous resin layer in a vertical cross-section of the test piece is observed under a microscope (manufactured by Keyence Corporation, VHX-200/100F) at a magnification of 100. As in the above case of having depressions and projections, the image is binarized into the pore part and the non-pore part, and the area ratio of the pore part is determined. The above operation is performed at ten horizontally consecutive points of the porous resin layer. The maximum and minimum values are excluded, and the average of the area ratios of the remaining eight points is defined as the pore area ratio.

The means for forming a large number of pores in the porous resin layer is not particularly limited, and a conventionally known method can be used. For example, physical foaming by mechanical stirring, chemical foaming by the addition of a foaming agent or a chemical reaction, pore formation by the addition of hollow fine particles, pore formation by the wet coagulation of a polyurethane resin, and the like can be mentioned. Preferably, chemical foaming is preferable, and chemical foaming using two or more kinds of temperature-sensitive catalysts is more preferable.

As the resin used as a base compound in the porous resin layer, that is, as the matrix-forming resin, for example, conventionally known synthetic resins such as a polyurethane resin, a vinyl chloride resin, a polyamino acid resin, an SBR resin, an NBR resin, an acrylic resin, a polyester resin, and copolymers thereof can be mentioned. They may be used alone, and it is also possible to use a combination of two or more kinds thereof. Among them, from the standpoint of wear resistance, texture, and the like, it is preferable that the matrix-forming resin contains a polyurethane resin. Polyurethane resin is a general term for polyurethane, which is a polymer compound having a urethane bond in the main chain, and resins containing such polyurethane as a main component, and thus may be a urethane bond-containing copolymer such as an acrylic urethane resin, or may also be a mixture of polyurethane and another resin, for example. The polyurethane resin according to one embodiment is not particularly limited, and, for example, a polycarbonate-based urethane resin, a polyether-based polyurethane resin, a polyester-based polyurethane resin, and the like can be mentioned. Among them, from the standpoint of durability, a polycarbonate-based polyurethane resin is more preferable.

The form of the resin is not particularly limited and may be solvent-free-based (non-solvent-based), solvent-based, or water-based, for example. In addition, whether the resin is one-component type or two-component curing type is not particularly limited either, and the type may be suitably selected according to the purpose and application. Among them, the two-component curing type is preferable for the reason that a porous resin layer can be easily formed by chemical foaming, and a solvent-free-based (non-solvent-based) resin is preferable from the standpoint of environmental load.

When a polyurethane resin is used as a base compound of the porous resin layer, such a resin is preferably obtained by a reaction between a polyol and a polyisocyanate.

The polyol is not particularly limited. For example, polyester polyols, polyether polyols, polycarbonate polyols, acrylic polyols, polyolefin polyols, castor oil polyols, silicon-modified polyols, and the like can be mentioned. They may be used alone, and it is also possible to use a combination of two or more kinds thereof. Among them, from the standpoint of durability, polycarbonate polyols are more preferable.

The number average molecular weight of the polyol is preferably 80 to 6,000, more preferably 100 to 6,000, and still more preferably 500 to 5,000. When the number average molecular weight is 80 or more, the urethane resin composition for a porous resin layer has an increased viscosity, and bubbles are less likely to escape from the resin layer. Further, when the number average molecular weight is 6,000 or less, the urethane resin composition for a porous resin layer has excellent rigidity. Incidentally, the number average molecular weight can be determined as a polystyrene-equivalent relative value measured by a gel permeation chromatography (GPC) method.

Meanwhile, the polyisocyanatc is not particularly limited either. For example, aromatic diisocyanates such as phenylene diisocyanate, tolylene diisocyanate (TDI), 4,4'-diphenylmethane diisocyanate (MDI), 2,4'-diphenylmethane diisocyanate, naphthalene diisocyanate, xylylene diisocyanate, and tetramethylxylylene diisocyanate, aliphatic or alicyclic diisocyanates such as hexamethylene diisocyanate, lysine diisocyanate, cyclohexane diisocyanate, isophorone diisocyanate, and dicyclohexylmethane diisocyanate, and polymeric MDIs containing dimers and trimers of 4,4'-diphenylmethane diisocyanate (MDI) can be mentioned. Among them, for the reason that it is easy to control the curing reaction, and also a porous resin layer can be easily formed, 4,4'-diphenylmethane diisocyanate (MDI) is preferable.

In a resin liquid for forming the porous resin layer (i.e., resin liquid for a porous resin layer), if necessary, within the range where the physical properties of the porous resin layer are not impaired, additives such as crosslinkers, catalysts, leveling agents, pigments, and delusterants can be used. Among them, for the reason that a stable porous state can be obtained, it is preferable to use a catalyst, especially a temperature-sensitive catalyst, and it is still more preferable to use two or more kinds of temperature-sensitive catalysts having different reaction temperatures. That is, in a preferred embodiment, the resin liquid for a porous resin layer is a resin liquid containing a matrix-forming resin and a temperature-sensitive catalyst, and more preferably a resin liquid containing a matrix-forming resin and two or more kinds of temperature-sensitive catalysts having different reaction temperatures. Therefore, in the preferred embodiment, the porous resin layer contains a matrix-forming resin and two or more kinds of temperature-sensitive catalysts having different reaction temperatures. The temperature-sensitive catalyst content in the resin liquid for a porous resin layer or the porous resin layer (the total content in the case where two or more kinds of temperature-sensitive catalysts are contained) is not particularly limited. For example, the solids content may be 0,002 to 10 parts by mass, or may be 0.02 to 1.0 part by mass, relative to 100 parts by mass of the matrix-forming resin (in the case of a two-component curable resin, e.g., a two-component curable polyurethane resin, the total amount of the polyol and the isocyanate curing agent).

A temperature-sensitive catalyst is a catalyst that is activated or highly activated by a temperature rise, and examples thereof include amine catalysts and metal catalysts. Among them, from the standpoint of environmental load, amine catalysts are preferable.

Amine catalysts are not particularly limited, and triethylamine, tributylamine, triethylenediamine, N,N,N',N'-tetramethylethylenediamine, diazabicycloalkenes, dialkyl ($C_{1-3}$) aminoalkyl ($C_{2-4}$) amines, heterocyclic aminoalkyl ($C_{2-6}$) amines, and organic salts thereof can be mentioned. They may be used alone, and it is also possible to use two or more kinds together. As diazabicycloalkenes, for example, 1,8-diazabicyclo[5,4,0]undecene-7 (DBU®), manufactured by San-Apro Ltd.), 1,5-diazabicyclo[4,3,0]nonene-5 (DBN), and the like can be mentioned. As dialkyl ($C_{1-3}$) aminoalkyl ($C_{2-4}$) amines, for example, dimethylaminoethylamine, dimethylaminopropylamine, diethylaminopropylamine, dipropylaminopropylamine, and the like can be mentioned. As heterocyclic aminoalkyl ($C_{2-6}$) amines, for example, 2-(1-aziridinyl) ethylamine, 4-(1-piperidinyl)-2-hexylamine, and the like can be mentioned. As organic salts, for example, aromatic carboxylic acid salts such as phthalate and benzoate, sulfonic acid salts such as p-toluenesulfonate and ethanesulfonic acid, fatty acid salts such as formate, acetate, and octylate, phenolic salts such as phenol salts, cresol salts, and naphthol salts, and the like can be mentioned.

Among them, as the temperature-sensitive amine catalyst, it is preferable to use an organic salt, that is, the salt of an amine and an organic acid described above. In an organic salt, presumably, the amine and the organic acid are ionized by a temperature rise, thereby promoting the catalytic effect of the amine, and the ionization temperature can be adjusted with the kind of organic acid. For the reason that such an ionization state can be easily adjusted with the heating temperature, the temperature-sensitive amine catalyst is preferably an organic salt of a diazabicycloalkene, and more preferably an organic salt of diazabicycloundecene (DBU).

As described above, in this embodiment, it is preferable to use two or more kinds of temperature-sensitive catalysts having different reaction temperatures. Because of the temperature-sensitive catalyst that reacts at a lower temperature, the crosslinked state of the porous resin layer can be promoted to stabilize the attached state (laminated state) of the porous resin layer and the fibrous substrate. In addition, because of the temperature-sensitive catalyst that reacts at a higher temperature, in a state where the layers are laminated, the crosslinking reaction of the porous resin layer can be promoted by a heat treatment. As a result thereof, a porous resin layer having a desired pore area ratio can be obtained. Incidentally, as used herein, a low temperature is within a range of less than 100° C. (more preferably 50° C. or more and less than 100° C.), and a high temperature is within a range of 100° C. or more (more preferably 100° C. or more and 170° C. or less).

In addition to the above additives, if necessary, a solvent may also be contained in the resin liquid for a porous resin layer.

In the synthetic leather according to this embodiment, a non-porous resin layer is laminated as a second resin layer on the porous resin layer described above. The non-porous resin layer is a layer for imparting durability, especially wear resistance.

As the resin constituting the non-porous resin layer, the same resins as those for the base compound of the porous resin layer can be used. Among them, from the standpoint of wear resistance, texture, and the like, the resin constituting the non-porous resin layer preferably contains a polyurethane resin as in the case of the porous resin layer. The polyurethane resin is not particularly limited, and, for example, a polycarbonate-based urethane resin, a polyether-based polyurethane resin, and the like can be mentioned. Among them, from the standpoint of durability, a polycarbonate-based polyurethane resin is more preferable.

The form of the resin is not particularly limited and may be solvent-free-based (non-solvent-based), solvent-based, or water-based, for example. In addition, whether the resin is one-component type or two-component curing type is not particularly limited either, and the type may be suitably selected according to the purpose and application. Among them, a one-component resin is preferable because a film can be formed simply by drying off the solvent, and an emulsification dispersion type (emulsion type) is preferable from the standpoint of environmental load.

In a resin liquid for forming the non-porous resin layer (i.e., resin liquid for a non-porous resin layer), known additives such as colorants, lubricants, crosslinkers, delusterants, and leveling agents can be used. In addition to the above additives, if necessary, a solvent is contained in the resin liquid for a non-porous resin layer. As the solvent, from the standpoint of environmental load, water is preferably used.

The thickness (T3) of the non-porous resin layer is not particularly limited, and is preferably 1 to 100 μm, more preferably 5 to 50 μm. When the thickness of the non-porous resin layer is 1 μm or more, the wear resistance can be improved. When the thickness of the non-porous resin layer is 100 μm or less, this is advantageous in suppressing sewing wrinkles and obtaining an excellent texture.

The density (S3) (apparent density) of the non-porous resin layer is not particularly limited, and is preferably 1 to 5 g/cm$^3$, more preferably 2 to 4 g/cm$^3$. When the density of the non-porous resin layer is 1 g/cm$^3$ or more, the wear resistance can be improved. When the density of the non-porous resin layer is 5 g/cm$^3$ or less, this is advantageous in suppressing sewing wrinkles and obtaining an excellent texture. Here, the density of the non-porous resin layer is calculated from its basis weight (g/cm$^2$) and thickness (cm).

In the synthetic leather of this embodiment, it is preferable that the total thickness (T1+T2) of the thickness (T1) of the fibrous substrate and the thickness (T2) of the porous resin layer and the thickness (T3) of the non-porous resin layer satisfy the following relation.

$$0.010 \leq T3/(T1+T2) \leq 0.060$$

When the total thickness of the fibrous substrate and the porous resin layer is set at a specific thickness to be within the above range relative to the thickness of the non-porous resin layer, the fibrous substrate and the porous resin layer, which have a large number of voids, occupy most of the thickness of the synthetic leather. Therefore, the absorption effect on the distortion caused by ease can be enhanced, and thus the distortion that occurs upon ease can be reduced. As a result, the suppression effect on sewing wrinkles upon sewing, especially upon ease sewing, can be enhanced. T3/(T1+T2) is more preferably 0.050 or less.

In the synthetic leather of this embodiment, it is preferable that the density (S1) of the fibrous substrate, the density (S2) of the porous resin layer, and the density (S3) of the non-porous resin layer satisfy the following relation.

$$S1 < S2 < S3$$

Such a relationship makes it possible to enhance the effectiveness in achieving both sewing wrinkle suppression and an excellent texture.

In addition, together with this density relation, it is preferable that the thickness (T1) of the fibrous substrate, the thickness (T2) of the porous resin layer, and the thickness (T3) of the non-porous resin layer satisfy the following relation.

$$T1 > T2 > T3$$

As a result, a thicker layer has a lower density, and thus the distortion caused by ease can be even more easily absorbed, making it possible to suppress the occurrence of sewing wrinkles more effectively, and also the texture can be further improved.

In the synthetic leather of this embodiment, it is preferable that the average density (S12) of the combined layer of the fibrous substrate and the porous resin layer is lower than the density (S3) of the non-porous resin layer. Such a relationship makes it possible to enhance the effectiveness in achieving both sewing wrinkle suppression and an excellent texture.

The density of the synthetic leather according to this embodiment is not particularly limited, and is preferably 0.35 to 0.60 g/cm$^3$, more preferably 0.40 to 0.58 g/cm$^3$, and still more preferably 0.51 to 0.56 g/cm$^3$. When the density of the synthetic leather is 0.35 g/cm$^3$ or more, the wear resistance can be improved. When the density of the synthetic leather is 0.60 g/cm$^3$ or less, this is advantageous in suppressing sewing wrinkles and obtaining an excellent texture. The density of a synthetic leather is the apparent density calculated from its basis weight (g/cm$^2$) and thickness (cm).

The synthetic leather according to this embodiment includes the fibrous substrate, the porous resin layer, and the non-porous resin layer as essential components, but may also include, if necessary, one or more layers between the layers. Further, each resin layer may be one layer or two or more layers.

The method for producing the synthetic leather according to this embodiment is not particularly limited. For example, as a first production method, the method may include the following steps in the following order:

- a step of applying a resin liquid for a porous resin layer onto a fibrous substrate to form a porous resin layer, and
- a step of applying a resin liquid for a non-porous resin layer onto the porous resin layer to form a non-porous resin layer.

Specifically, in the first production method, it is possible that a resin liquid for a porous resin layer is applied to one side of a fibrous substrate and then dry-coagulated to laminate a porous resin layer on the fibrous substrate, and then a resin liquid for a non-porous resin layer is applied onto the porous resin layer and then dry-coagulated to laminate a non-porous resin layer.

As a second production method for the synthetic leather according to this embodiment, the method may include the following steps in the following order:

a step of applying a resin liquid for a non-porous resin layer onto a releasable substrate to form a non-porous resin layer, a step of applying a resin liquid for a porous resin layer onto the non-porous resin layer to form a porous resin layer, a step of attaching the porous resin layer and a fibrous substrate together, and a step of peeling the releasable substrate.

Specifically, in the second production method, it is possible that (A) a resin liquid for a non-porous resin layer is applied onto a releasable substrate and then dry-coagulated to form a non-porous resin layer, and then a resin liquid for a porous resin layer is applied onto the non-porous resin layer and then, while being viscous, pressure-bonded to one side of a fibrous substrate to attach the porous resin layer and the fibrous substrate together, followed by peeling the releasable substrate. Alternatively, it is also possible that (B) a resin liquid for a non-porous resin layer is applied onto a releasable substrate and then dry-coagulated to form a non-porous resin layer, then a resin liquid for a porous resin layer is applied onto the non-porous resin layer and then dry-coagulated to form a porous resin layer and a non-porous resin layer on the releasable substrate, and subsequently the porous resin layer and one side of a fibrous substrate are attached together by an adhesive to laminate the porous resin layer and the non-porous resin layer on the fibrous substrate via an adhesive layer, followed by peeling the releasable substrate.

In these second production methods, it is also possible that a resin liquid for a second non-porous resin layer is applied to the surface of the non-porous resin layer from which the releasable substrate has been peeled, and then dry-coagulated to form a second non-porous resin layer.

As a method for applying each resin liquid, known methods such as knife coating, roll coating, gravure coating, and spray coating can be mentioned.

The applications of the synthetic leather according to this embodiment are not particularly limited. For example, the synthetic leather can be used for interior material applications for various vehicles, including automotive interior materials such as automotive seats, ceiling materials, dashboards, door lining materials, and steering wheels, as well as interior decoration applications, such as skins for sofas and chairs, and fashion applications, such as bags and shoes.

With respect to the numerical ranges for the thickness T1 and density S1 of the fibrous substrate, the thickness T2, density S2, pore major axis, and pore area ratio of the porous resin layer, the thickness T3 and density S3 of the non-porous resin layer, the thickness, density, and BLC value of the synthetic leather, T3/(T1+T2), the average density S12 of the combined layer of the fibrous substrate and the porous resin layer, and the like described above, the upper limit and lower limit of each range can be arbitrarily combined, and all such combinations are incorporated herein as preferred numerical ranges.

EXAMPLES

Hereinafter, the invention will be described in further detail with reference to examples. However, the invention is not limited to the following examples.

The evaluation items followed the below methods.

[Sewing Wrinkles]

An obtained synthetic leather was sewn under the following sewing conditions to prepare an automotive seat cover, and the state of sewing wrinkles was visually checked and evaluated according to the following judgment criteria.

A: No sewing wrinkles occurred.

B: Sewing wrinkles occurred, but not noticeable.

C: Noticeable sewing wrinkles occurred.

(Sewing Conditions)

Two test pieces A, each having a width of 10 cm and a length of 10 cm, and two test pieces B, each having a width of 11 cm and a length of 11 cm, are taken. The warp directions, or the weft directions, of the test pieces A and B are combined and sewn together. The seam allowance is set at 5 mm from the end of each test piece. Setting the stitch pitch at "25±2 stitches per 10 cm", the test pieces A and B are sewn together in such a manner that they match in terms of the start and end of sewing. Of the combination of the warp directions and the combination of the weft directions, the one with the worse judgment result is selected and the evaluation thereof is used as the evaluation of sewing wrinkles.

[Wear Resistance]

Test pieces having a size of 70 mm in width and 300 mm in length were obtained, one in the longitudinal direction and one in the transverse direction. To the back surface of each obtained test piece, a urethane foam having a width of 70 mm, a length of 300 mm, and a thickness of 10 mm was attached. In a state where a 4.5-mm diameter wire being installed at the center of the lower surface of the urethane foam, the test piece was fixed to Plane Abrasion Tester T-TYPE (manufactured by Daiei Kagaku Seiki Seisakusho Co., Ltd.), and the surface was rubbed with the friction block while applying a load of 9.8 N to the friction block in such a manner that a friction block covered with a cotton cloth (JIS L3102: Cotton Canvas No. 6) reciprocated above and parallel to the wire, thereby performing a friction test. The friction block was reciprocated through a distance of 140 mm on the surface of the test piece 3,000 times at a rate of 60 reciprocations/minute. The synthetic leather after rubbing was visually checked and evaluated according to the following judgment criteria.

A: No change on the resin layer surface.

B: There is chipping on the resin layer surface.

C: There is cracking on the resin layer surface.

D: There is significant cracking or a resin layer lost part (fibrous substrate exposed part) on the resin layer surface.

Example 1

[Fibrous Substrate]

A 22-gauge circular-knitted polyester fabric (thickness: 740 specific density: 0.29 g/cm$^3$) was used as a fibrous substrate.

TABLE 1

[Formulation 1 (Resin Liquid for First Non-Porous Resin Layer)]

| | |
|---|---|
| Base compound: Polycarbonate-based polyurethane resin "CRISVON NY-328", manufactured by Dainippon Ink and Chemicals, Inc. | 90 parts by mass |
| Isocyanate-based crosslinker "BURNOCK DN950", manufactured by Dainippon Ink and Chemicals, Inc. | 1 part by mass |
| Carbon black-based black pigment (solids content: 25 mass %) "DIALAC BLACK L-1770S", manufactured by Dainippon Ink and Chemicals, Inc. | 20 parts by mass |

Preparation Method

The raw materials were mixed in a mixer according to Formulation 1. At this time, the viscosity was adjusted to 2,000 mPa·s (B type viscometer, manufactured by Tokyo Keiki Inc., Rotor No. 4, 12 rpm, 23° C.).

TABLE 2

| [Formulation 2 (Resin Liquid for Porous Resin Layer)] | |
|---|---|
| Polycarbonate polyol (number average molecular weight: 2,000) "Kuraray Polyol C2090", manufactured by Kuraray Co., Ltd. | 100 parts by mass |
| Temperature-sensitive catalyst 1 (DBU phenol salt, reaction temperature: 70° C., solids content: 0.1 mass %) "U-CAT SA1", manufactured by San-Apro Ltd. | 0.1 parts by mass |
| Temperature-sensitive catalyst 2 (DBU paratoluene sulfonate, reaction temperature: 100° C., solids content: 0.1 mass %) "U-CAT SA506", manufactured by San-Apro Ltd. | 0.1 parts by mass |
| Isocyanate-based curing agent (solids content: 50 mass %) 4,4'-Diphenylmethane diisocyanate (MDI) | 15 parts by mass |

Preparation Method

The raw materials were mixed in a mixer according to Formulation 2. At this time, the viscosity was adjusted to 5,000 mPa·s (B type viscometer, manufactured by Tokyo Keiki Inc., Rotor No. 4, 12 rpm, 23° C.). The equivalent ratio (hydroxyl group/isocyanate group) was adjusted to 1.20.

TABLE 3

| [Formulation 3 (Resin Liquid for Second Non-Porous Resin Layer)] | |
|---|---|
| Base compound: Water-based polycarbonate-based polyurethane resin "BAYDERM Finish 61UD", manufactured by LANXESS | 90 parts by mass |
| Delusterant: Silica-containing water-based polycarbonate-based urethane resin "HYDRHOLAC UD-2", manufactured by LANXESS | 10 parts by mass |
| Isocyanate-based crosslinker "AQUADERM XL-50", manufactured by LANXESS | 1 part by mass |
| Silicone-based leveling agent (solids content: 100 mass %) "AQUADERM Fluid H", manufactured by LANXESS | 1 part by mass |
| Water | 20 parts by mass |

Preparation Method

The raw materials were mixed in a mixer according to Formulation 3. At this time, the viscosity was adjusted to 200 mPa·s (B type viscometer, manufactured by Tokyo Keiki Inc., Rotor No. 1, 12 rpm, 23° C.).

The resin liquid for a first non-porous resin layer prepared above according to Formulation 1 was applied with a comma coater to a release paper having a grain tone depression-and-projection pattern (AR-96M, manufactured by Asahi Roll Co., Ltd.) to form a sheet having an average coating thickness of 100 μm, and then treated in a dryer at 100° C. for 3 minutes to form a first non-porous resin layer.

Next, the resin liquid for a porous resin layer prepared above according Formulation 2 was applied with a comma coater to the surface of the first non-porous resin layer formed on the release paper to an average coating thickness of 200 μm, then treated at 110° C. for 3 minutes, and subsequently, while being viscous, attached to a circular-knitted polyester fabric (fibrous substrate) and pressed at 392 N/cm$^2$ for 1 minute, followed by peeling the release paper.

Next, the resin liquid for a second non-porous resin layer prepared above according to Formulation 3 was applied with a reverse coater to the surface of the first non-porous resin layer, from which the release paper had been peeled, to form a sheet having an average thickness of 50 μm, and then treated in a dryer at 100° C. for 3 minutes to form a second non-porous resin layer, thereby giving a synthetic leather of Example 1.

In the obtained synthetic leather, the porous resin layer had a mono-layer structure, and the pores were closed pores. Depressions and projections were present on the back surface of the porous resin layer, and also on the front surface and back surface of the non-porous resin layer. The pore size (major axis) was 50 μm, and the pore area ratio was 48%, The thickness of the first non-porous resin layer was 31 μm, the thickness of the second non-porous resin layer was 10 and the thickness of the non-porous resin layer was 41 μm. The thickness of the porous resin layer was 198 μm, and the thickness of the synthetic leather was 981 μm.

Incidentally, the thickness of each layer was measured by observing a vertical cross-section of the synthetic leather under a microscope (manufactured by Keyence Corporation, VHX-200/100F) at a magnification of 100. The thicknesses at arbitrary ten points were measured, and their average was calculated.

The pore size (major axis) was determined as follows. A vertical cross-section of the synthetic leather was observed under a microscope (VHX-200/100F, manufactured by Keyence Corporation) at a magnification of 100, and the major axis of the pore having the largest major axis was measured. This measurement was performed on vertical cross-sections at ten horizontally consecutive points of the porous resin layer. The maximum and minimum values were excluded, and the average value at the remaining eight points was calculated.

The density of the non-porous resin layer was calculated from the following formula.

Density of non-porous resin layer [g/cm$^3$]={(density of first non-porous resin layer [g/cm$^3$]×thickness of first non-porous resin layer [cm])+(density of second non-porous resin layer [g/cm$^3$]×thickness of second non-porous resin layer [cm])}÷(thickness of first non-porous resin layer [cm]+thickness of second non-porous resin layer [cm])

Examples 2 and 3, Comparative Example 1

Synthetic leathers of Examples 2 and 3 and Comparative Example 1 were obtained in the same manner as in Example 1, except that the temperature for heat-treating the porous resin layer was changed from 110° C. in Example 1 to 60° C. in Example 2, 160° C. in Example 3, and 35° C. in Comparative Example 1.

Examples 4 and 5

Synthetic leathers of Examples 4 and 5 were obtained in the same manner as in Example 1, except that the coating thickness of the resin liquid for a porous resin layer was changed. The thickness of the porous resin layer was 25 μm in Example 4 and 278 μm in Example 5.

Examples 6 and 7

Synthetic leathers of Examples 6 and 7 were obtained in the same manner as in Example 1, except that the coating thicknesses of the resin liquids for first and second non-porous resin layers were changed. In Example 6, the thickness of the first non-porous resin layer was 2.6 μm, the thickness of the second non-porous resin layer was 0.4 μm, and the thickness of the non-porous resin layer was 3 μm. In Example 7, the thickness of the first non-porous resin layer was 83 μm, the thickness of the second non-porous resin layer was 12 μm, and the thickness of the non-porous resin layer was 95 μm.

Examples 8 and 9, Comparative Examples 2 and 3

Synthetic leathers of Examples 8 and 9 and Comparative Examples 2 and 3 were obtained in the same manner as in Example 1, except that the coating thickness of the resin liquid for a porous resin layer and the coating thicknesses of the resin liquids for first and second non-porous resin layers were changed.

In Example 8, the thickness of the porous resin layer was 60 μm, the thickness of the first non-porous resin layer was 17.6 μm, the thickness of the second non-porous resin layer was 2.4 μm, and the thickness of the non-porous resin layer was 20 μm. In Example 9, the thickness of the porous resin layer was 290 μm, the thickness of the first non-porous resin layer was 77 μm, the thickness of the second non-porous resin layer was 12 μm, and the thickness of the non-porous resin layer was 89 μm.

In Comparative Example 2, the thickness of the porous resin layer was 20 μm, the thickness of the first non-porous resin layer was 4.4 μm, the thickness of the second non-porous resin layer was 0.6 μm, and the thickness of the non-porous resin layer was 5 μm. In Comparative Example 3, the thickness of the porous resin layer was 25 μm, the thickness of the first non-porous resin layer was 10.4 μm, the thickness of the second non-porous resin layer was 1.6 μm, and the thickness of the non-porous resin layer was 12 μm.

Example 10

A synthetic leather of Example 10 was obtained in the same manner as in Example 1, except that the temperature-sensitive catalyst 2 was removed from Formulation 2 of the resin liquid for a porous resin layer.

Example 11

A synthetic leather of Example 11 was obtained in the same manner as in Example 1, except that in Formulation 2 of the resin liquid for a porous resin layer, 0.1 parts by mass of the temperature-sensitive catalyst 2 was replaced with 0.1 parts by mass of a temperature-sensitive catalyst 3 (DBU octylate, reaction temperature: 100° C., solids content: 0.1 mass %, "U-CAT SA102", manufactured by San-Apro Ltd.).

Example 12

A synthetic leather of Example 12 was obtained in the same manner as in Example 1, except that in Formulation 2 of the resin liquid for a porous resin layer, 100 parts by mass of the polycarbonate-based polyol was replaced with 100 parts by mass of a polyester-based polyol ("Kuraray Polyol P2010", manufactured by Kuraray Co., Ltd., number average molecular weight: 2,000).

TABLE 4

| | | | Ex. 1 | Ex. 2 | Ex. 3 | Ex. 4 | Ex. 5 | Ex. 6 | Ex. 7 | Ex. 8 |
|---|---|---|---|---|---|---|---|---|---|---|
| Configuration | Fibrous Substrate | Thickness T1 (μm) | 742 | 740 | 738 | 739 | 738 | 741 | 738 | 740 |
| | | Density S1 (g/cm$^3$) | 0.29 | 0.30 | 0.29 | 0.29 | 0.30 | 0.30 | 0.29 | 0.29 |
| | Porous Resin Layer | Thickness T2 (μm) | 198 | 152 | 227 | 25 | 278 | 199 | 202 | 60 |
| | | Density S2 (g/cm$^3$) | 0.89 | 0.99 | 0.71 | 1.32 | 0.65 | 0.90 | 0.90 | 1.13 |
| | | Pore Major Axis (μm) | 50 | 45 | 53 | 47 | 51 | 49 | 49 | 46 |
| | | Pore Area Ratio (%) | 48 | 36 | 60 | 25 | 65 | 50 | 47 | 30 |
| | Non-Porous Resin Layer | Thickness T3 (μm) | 41 | 39 | 41 | 41 | 40 | 3 | 95 | 20 |
| | | Density S3 (g/cm$^3$) | 2.7 | 2.8 | 2.7 | 2.7 | 2.7 | 2.6 | 2.7 | 2.8 |
| | Synthetic Leather | Thickness (μm) | 981 | 931 | 1006 | 805 | 1056 | 943 | 1035 | 820 |
| | | Density (g/cm$^3$) | 0.51 | 0.52 | 0.48 | 0.44 | 0.48 | 0.43 | 0.63 | 0.41 |
| | | Relation between Total Thickness of Fibrous Substrate Thickness + Porous Resin Layer Thickness and Thickness of Non-Porous Resin Layer (T3/(T1 + T2)) | 0.044 | 0.044 | 0.042 | 0.054 | 0.039 | 0.003 | 0.101 | 0.025 |
| | | Average Density of Combined Layer of Fibrous Substrate and Porous Resin Layer (S12) | 0.42 | 0.42 | 0.39 | 0.32 | 0.40 | 0.43 | 0.42 | 0.35 |
| | | BLC Value (mm) | 5.4 | 5.2 | 5.7 | 5.6 | 5.2 | 5.5 | 5.2 | 5.7 |
| Evaluation Results | Sewing Wrinkles | | A | B | A | B | A | A | B | A |
| | Wear Resistance | | A | A | B | A | B | B | A | B |

| | | | Ex. 9 | Ex. 10 | Ex. 11 | Ex. 12 | Comparative Ex. 1 | Comparative Ex. 2 | Comparative Ex. 3 |
|---|---|---|---|---|---|---|---|---|---|
| Configuration | Fibrous Substrate | Thickness T1 (μm) | 1452 | 737 | 742 | 740 | 736 | 742 | 740 |
| | | Density S1 (g/cm$^3$) | 0.30 | 0.30 | 0.29 | 0.32 | 0.30 | 0.31 | 0.29 |
| | Porous Resin Layer | Thickness T2 (μm) | 290 | 175 | 200 | 202 | 25 | 20 | 25 |
| | | Density S2 (g/cm$^3$) | 0.61 | 0.93 | 0.91 | 0.88 | 1.39 | 1.25 | 1.32 |
| | | Pore Major Axis (μm) | 50 | 40 | 53 | 48 | 28 | 38 | 45 |
| | | Pore Area Ratio (%) | 69 | 42 | 50 | 48 | 14 | 17 | 25 |

TABLE 4-continued

| | | | | | | | | | |
|---|---|---|---|---|---|---|---|---|---|
| | Non-Porous Resin Layer | Thickness T3 (μm) | 89 | 41 | 40 | 38 | 41 | 5 | 12 |
| | | Density S3 (g/cm$^3$) | 2.7 | 2.6 | 2.7 | 2.8 | 2.7 | 2.9 | 2.6 |
| | Synthetic Leather | Thickness (μm) | 1831 | 953 | 982 | 980 | 802 | 767 | 777 |
| | | Density (g/cm$^3$) | 0.47 | 0.51 | 0.51 | 0.53 | 0.46 | 0.35 | 0.36 |
| | | Relation between Total Thickness of Fibrous Substrate Thickness + Porous Resin Layer Thickness and Thickness of Non-Porous Resin Layer (T3/(T1 + T2)) | 0.051 | 0.045 | 0.042 | 0.040 | 0.054 | 0.007 | 0.016 |
| | | Average Density of Combined Layer of Fibrous Substrate and Porous Resin Layer (S12) | 0.35 | 0.42 | 0.42 | 0.44 | 0.34 | 0.33 | 0.32 |
| | | BLC Value (mm) | 5.0 | 5.0 | 5.5 | 5.3 | 4.5 | 5.9 | 5.8 |
| Evaluation Results | Sewing Wrinkles | | B | B | A | A | C | C | C |
| | Wear Resistance | | A | A | A | A | A | B | B |

The results are as shown in Table 4. In Comparative Example 1 where the pore area ratio of the porous resin layer is small, Comparative Example 3 where the thickness of the synthetic leather is small, and Comparative Example 2 where the pore area ratio of the porous resin layer and the thickness of the synthetic leather are both small, noticeable sewing wrinkles occurred upon ease sewing. Meanwhile, in Examples 1 to 12, the BLC value was large, that is, the texture of the synthetic leather was excellent, and yet it was possible to improve sewing wrinkles upon ease sewing.

REFERENCE SIGNS LIST

1: Synthetic leather
2: Fibrous substrate
3: Porous resin layer
4: Non-porous resin layer
5: Front surface
6: Adhesive layer
10: Synthetic leather

The invention claimed is:

1. A synthetic leather comprising a fibrous substrate, a non-porous resin layer, and a porous resin layer provided between the fibrous substrate and the non-porous resin layer, wherein the synthetic leather has a thickness of 800 μm or more, and a vertical cross-section of the porous resin layer has a pore area ratio of 25% or more, wherein the fibrous substrate has a density (S1) of 0.05 to 1.0 g/cm$^3$, the porous resin layer has a density (S2) of 0.1 to 2.0 g/cm$^3$, and the non-porous resin layer has a density (S3) of 2 to 5 g/cm$^3$.

2. The synthetic leather according to claim 1, wherein the porous resin layer has a thickness of 20 to 300 μm.

3. The synthetic leather according to claim 1, wherein the non-porous resin layer has a thickness of 1 to 100 μm.

4. The synthetic leather according to claim 1, wherein the porous resin layer contains a matrix-forming resin and two or more kinds of temperature-sensitive catalysts having different reaction temperatures.

5. The synthetic leather according to claim 4, wherein the matrix-forming resin is a polyurethane resin obtained by allowing a polyol containing a polyester polyol and/or a polycarbonate polyol to react with a polyisocyanate containing an aromatic diisocyanate.

6. The synthetic leather according to claim 4, wherein the temperature-sensitive catalysts each contain an organic salt of a diazabicycloalkene.

7. The synthetic leather according to claim 1, wherein pores in the porous resin layer are closed pores.

8. The synthetic leather according to claim 1, wherein the fibrous substrate has a thickness (T1) of 400 to 10,000 μm, the porous resin layer has a thickness (T2) of 20 to 300 μm, the non-porous resin layer has a thickness (T3) of 1 to 100 μm, and the thickness (T1) of the fibrous substrate, the thickness (T2) of the porous resin layer, and the thickness (T3) of the non-porous resin layer satisfy the relations of the following formulas (1) and (2):

$$T1>T2>T3 \quad (1)$$

$$0.010 \leq T3/(T1+T2) \leq 0.060 \quad (2).$$

9. The synthetic leather according to claim 1, wherein a combined layer of the fibrous substrate and the porous resin layer has an average density of 0.1 to 1.0 g/cm$^3$, the synthetic leather has a density of 0.35 to 0.60 g/cm$^3$, and the density (S1) of the fibrous substrate, the density (S2) of the porous resin layer, and the density (S3) of the non-porous resin layer (S3) satisfy the relation of the following formula (3):

$$S1<S2<S3 \quad (3).$$

10. The synthetic leather according to claim 1, wherein the non-porous resin layer includes a first non-porous resin layer provided on the porous resin layer and a second non-porous resin layer provided on the first non-porous resin layer.

11. The synthetic leather according to claim 1, wherein the front surface of the synthetic leather, which is formed of the non-porous resin layer, has depressions and projections, and the front surface and back surface of the porous resin layer each have depressions and projections.

12. The synthetic leather according to claim 1, wherein the front surface of the synthetic leather, which is formed of the non-porous resin layer, is flat, and the front surface and back surface of the porous resin layer each have depressions and projections.

13. The synthetic leather according to claim 1, wherein the synthetic leather has a BLC value of 4.5 to 6.5 mm.

14. A method for producing a synthetic leather, for producing the synthetic leather according to claim 1, the method comprising the following steps in the following order:

a step of applying a resin liquid for a non-porous resin layer onto a releasable substrate to form a non-porous resin layer, a step of applying a resin liquid for a porous resin layer onto the non-porous resin layer to form a porous resin layer, a step of attaching the porous resin layer and a fibrous substrate together, and a step of peeling the releasable substrate.

15. The method for producing a synthetic leather according to claim 14, wherein the resin liquid for a porous resin layer is a resin liquid that contains a matrix-forming resin and a temperature-sensitive catalyst.

16. The method for producing a synthetic leather according to claim 14, further comprising a step of applying a resin liquid for a second non-porous resin layer to the surface of the non-porous resin layer from which the releasable substrate has been peeled to form a second non-porous resin layer.

17. The synthetic leather according to claim 12, wherein the back surface of the non-porous resin layer and the front surface of the porous resin layer are in continuous contact to form an interface between the non-porous resin layer and the porous resin layer, and wherein the back surface of the non-porous resin layer and the front surface of the porous resin layer are provided with corresponding depressions and projections.

* * * * *